US009145889B2

(12) United States Patent
Kim et al.

(10) Patent No.: US 9,145,889 B2
(45) Date of Patent: Sep. 29, 2015

(54) SCROLL COMPRESSOR

(71) Applicants: Pilhwan Kim, Changwon-Si (KR); Injong Jang, Changwon-Si (KR)

(72) Inventors: Pilhwan Kim, Changwon-Si (KR); Injong Jang, Changwon-Si (KR)

(73) Assignee: LG ELECTRONICS INC., Seoul (KR)

( * ) Notice: Subject to any disclaimer, the term of this patent is extended or adjusted under 35 U.S.C. 154(b) by 237 days.

(21) Appl. No.: 13/778,278

(22) Filed: Feb. 27, 2013

(65) Prior Publication Data

US 2013/0224054 A1 Aug. 29, 2013

(30) Foreign Application Priority Data

Feb. 27, 2012 (KR) ..... 10-2012-0019861

(51) Int. Cl.

| | |
|---|---|
| ***F01C 1/02*** | (2006.01) |
| ***F04C 18/00*** | (2006.01) |
| ***F01C 21/10*** | (2006.01) |
| ***F04C 23/00*** | (2006.01) |
| ***F04C 18/02*** | (2006.01) |

(52) U.S. Cl.

CPC ..... *F04C 18/00* (2013.01); *F01C 21/10* (2013.01); *F04C 18/0215* (2013.01); *F04C 18/0253* (2013.01); *F04C 23/008* (2013.01)

(58) Field of Classification Search

CPC .... F04C 18/00; F04C 23/008; F04C 18/0215; F01C 21/10

USPC ..... 418/55.1–55.6, 270

See application file for complete search history.

(56) References Cited

U.S. PATENT DOCUMENTS

| | | | | | |
|---|---|---|---|---|---|
| 5,055,010 | A | * | 10/1991 | Logan | 417/410.5 |
| 5,395,224 | A | * | 3/1995 | Caillat et al. | 418/55.6 |
| 5,447,418 | A | * | 9/1995 | Takeda et al. | 418/55.2 |
| 5,611,674 | A | * | 3/1997 | Bass et al. | 417/220 |
| 5,741,120 | A | * | 4/1998 | Bass et al. | 417/44.2 |
| 5,810,573 | A | * | 9/1998 | Mitsunaga et al. | 418/55.6 |
| 6,056,523 | A | * | 5/2000 | Won et al. | 418/15 |

(Continued)

FOREIGN PATENT DOCUMENTS

| | | |
|---|---|---|
| AU | 2010 212 403 | 9/2010 |
| CN | 1280251 | 1/2001 |

(Continued)

OTHER PUBLICATIONS

European Search Report dated May 10, 2013.

(Continued)

*Primary Examiner* — Kenneth Bomberg
*Assistant Examiner* — Jason T Newton
(74) *Attorney, Agent, or Firm* — Ked & Associates, LLP

(57) ABSTRACT

A scroll compressor is provided that may include a discharge cover that separates a suction space and a discharge space of an airtight container. The discharge cover may be inserted into a fixed scroll to be fixedly coupled thereto, reducing an amount of components, such as a gasket and fastening bolts required to fix the discharge cover, and an assembly time, reducing overall production costs. Also, as fastening bolts are not used, a width corresponding to a space for bolts may be reduced in the fixed scroll, whereby a phenomenon in which the fixed scroll is heated by a discharge refrigerant within the discharge space may be reduced, reducing suction loss of the refrigerant sucked into the compression chamber and improving compressor efficiency. Also, a size of the fixed scroll may be reduced, reducing a weight of the fixed scroll, and a weight of the overall compressor.

19 Claims, 8 Drawing Sheets

(56) References Cited

U.S. PATENT DOCUMENTS

| | | | | |
|---|---|---|---|---|
| 6,203,298 | B1 * | 3/2001 | Scarfone et al. | 418/55.1 |
| 6,220,839 | B1 * | 4/2001 | Sheridan et al. | 418/55.1 |
| 6,406,266 | B1 * | 6/2002 | Hugenroth et al. | 417/44.1 |
| 6,418,740 | B1 * | 7/2002 | Williams et al. | 62/196.3 |
| 6,457,948 | B1 * | 10/2002 | Pham | 417/292 |
| 2002/0085939 | A1 * | 7/2002 | Sun et al. | 418/55.5 |
| 2002/0114719 | A1 * | 8/2002 | Itoh et al. | 418/55.2 |
| 2002/0114720 | A1 | 8/2002 | Itoh et al. | |
| 2003/0099564 | A1 * | 5/2003 | Witham et al. | 418/55.1 |
| 2004/0126261 | A1 | 7/2004 | Kammhoff et al. | |
| 2005/0069444 | A1 * | 3/2005 | Peyton | 418/55.1 |
| 2005/0232800 | A1 * | 10/2005 | Kammhoff et al. | 418/55.6 |
| 2010/0254841 | A1 | 10/2010 | Akei et al. | |

FOREIGN PATENT DOCUMENTS

| | | |
|---|---|---|
| CN | 1688817 | 10/2005 |
| CN | 201443511 | 4/2010 |
| JP | H08-312562 | 11/1996 |

OTHER PUBLICATIONS

Chinese Office Action dated Feb. 4, 2015. (with English Translation).

* cited by examiner

SCROLL COMPRESSOR

CROSS-REFERENCE TO RELATED APPLICATION(S)

Pursuant to 35 U.S.C. §119(a), this application claims priority to Korean Application No. 10-2012-0019861, filed in Korea on Feb. 27, 2012, the contents of which is incorporated by reference herein in its entirety.

BACKGROUND

1. Field

A scroll compressor is disclosed herein.

2. Background

Scroll compressors are known. However, they suffer from various disadvantages.

BRIEF DESCRIPTION OF THE DRAWINGS

Embodiments will be described in detail with reference to the following drawings in which like reference numerals refer to like elements, and wherein.

DETAILED DESCRIPTION

Figure 1:
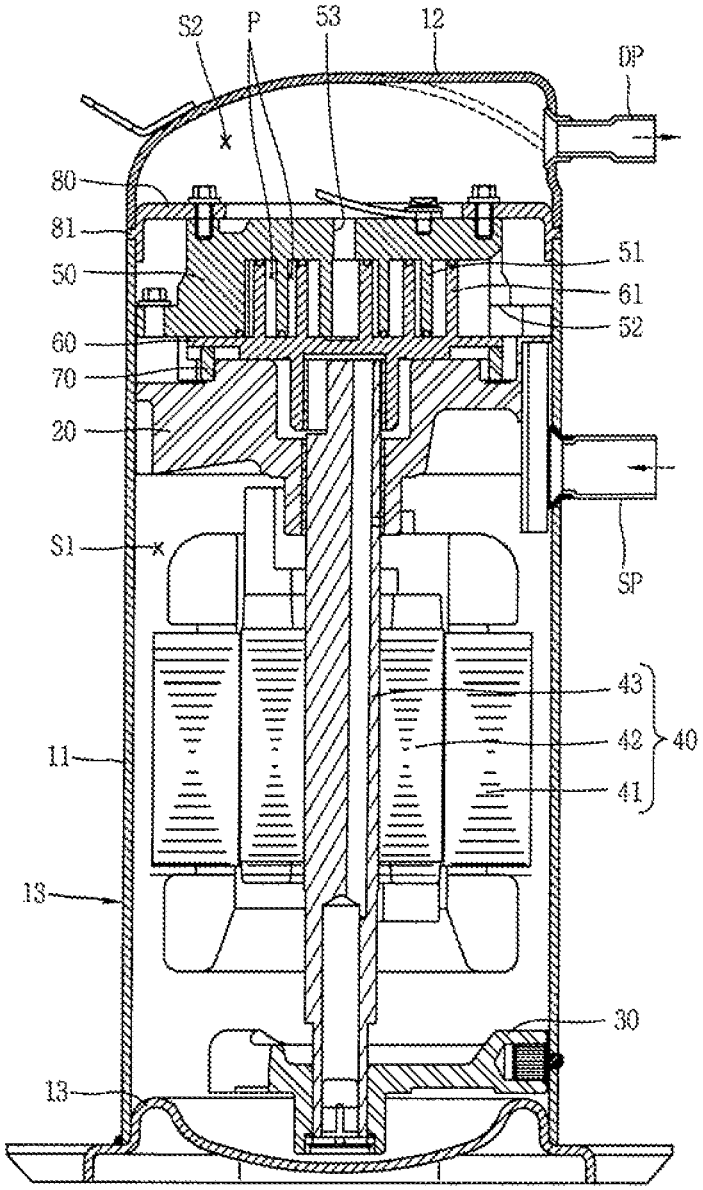
FIG. 1 RELATED ART
FIG. 1 is a vertical sectional view of a low pressure scroll compressor.

A scroll compressor according to embodiments will be described with reference to the accompanying drawings. Where possible, like reference numerals have been used to indicate like elements, and repetitive disclosure has been omitted.

A scroll compressor is a compressor that compresses a refrigerant gas by changing a volume of a compression chamber(s) formed by a pair of opposing scrolls. In comparison to a reciprocating compressor or a rotary compressor, a scroll compressor has high efficiency, low vibration and noise, and may be reduced in size and weight, and thus, such scroll compressors have been widely used, especially, in air-conditioners.

A scroll compressor may be divided into a low pressure scroll compressor and a high pressure compressor according to a pressure of a refrigerant filling an internal space of an airtight container thereof. In a low pressure scroll compressor, a suction pipe may communicate with an internal space of an airtight container, and a refrigerant may be indirectly sucked into a compression chamber(s) through the internal space. In comparison, in a high pressure scroll compressor, a suction pipe may directly communicate with a suction side of a compression device, and a refrigerant may be directly sucked into a compression chamber(s), without passing through an internal space of an airtight container.

FIG. 1 is a vertical sectional view of a low pressure scroll compressor. As illustrated, in the low pressure scroll compressor of FIG. 1, an internal space of an airtight container 10 may be divided into a suction space S1 and a discharge space S2. The internal space of the airtight container 10 may be divided into the suction space S1 and the discharge space S2 by a main frame 20 or a fixed scroll 50, or may be divided into the suction space S1 and the discharge space S2 by a discharge plenum (not shown) fixed to an upper surface of the fixed scroll 50 or a discharge cover 80 as shown in FIG. 1.

Figure 2:
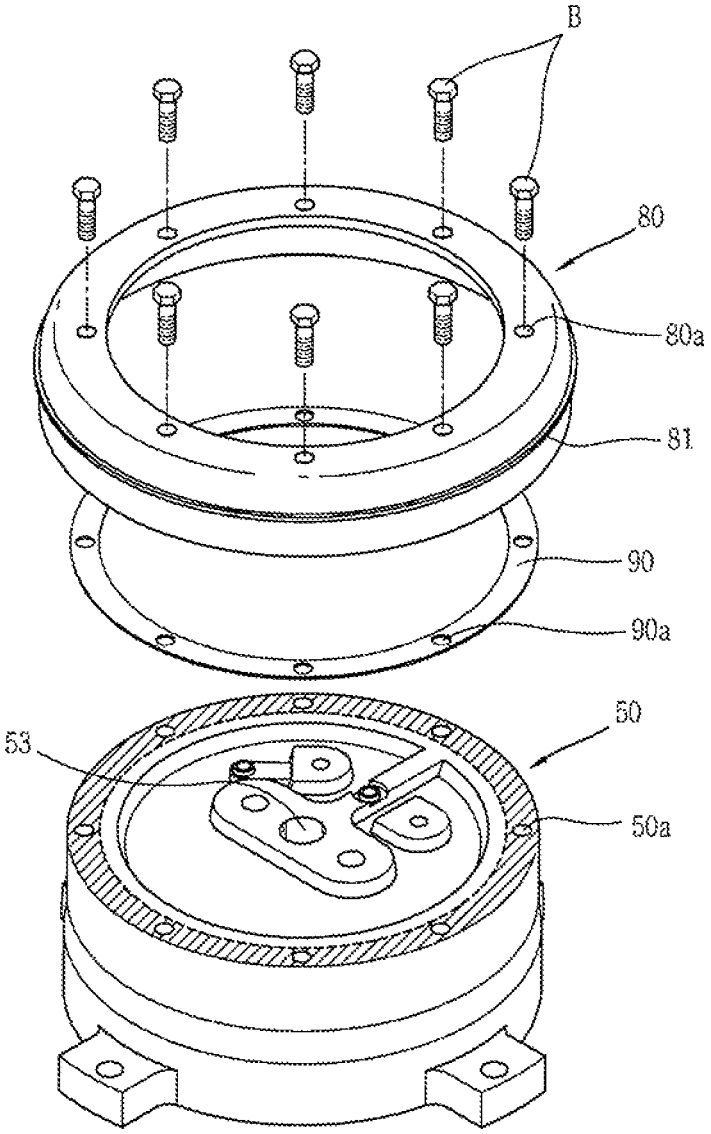
FIG. 2 RELATED ART
FIG. 2 is an exploded perspective view of a fixed scroll and a discharge cover of the low pressure scroll compressor of FIG. 1.

As shown in FIG. 2, the discharge cover 80 may have an annular shape. An outer circumference side of the discharge cover 80 may be airtightly coupled to the airtight container 10, and an inner circumference side of the discharge cover 80 may be fixedly coupled to an upper surface of the fixed scroll 50 to cover a discharge opening 53. The outer circumferential surface of the discharge cover 80 may be bent, and a support protrusion 81, which may have a band-like shape, may be formed on the outer circumferential surface thereof. The support protrusion 81 may be inserted between a shell 11 and an upper cap 12 of the airtight container 10 and supported in an axial direction.

A gasket 90 may be disposed at a bottom of an inner circumference of the discharge cover 80 and supported on an upper surface of the fixed scroll 50, in order to prevent a refrigerant discharged to the discharge space S2 from being leaked to the suction space S1. The discharge cover 80 may be fixedly coupled to the fixed scroll 50 by using, for example, a plurality of fastening bolts B fastened to the fixed scroll 50, upon passing through the discharge cover 80 and the gasket 90, via fastening recesses or holes 50*a*, 80*a*, 90*a*.

Reference numeral 13 denotes a lower cap, reference numeral 30 denotes a lower frame, reference numeral 40 denotes a drive motor, reference numeral 41 is a stator, reference numeral 42 denotes a rotor, reference numeral 43 denotes a crank shaft, reference numeral 51 denotes a fixed wrap, reference numeral 52 denotes a suction opening, reference numeral 60 denotes an orbiting scroll, reference numeral 61 denotes an orbiting wrap, reference numeral 70 denotes an Oldham ring, reference letters SP denote a suction pipe, reference letters DP denote a discharge pipe, and reference numeral P denotes a compression chamber(s).

However, in the scroll compressor of FIGS. 1-2, as the inner circumference of the discharge cover 80 is fastened to the fixed scroll 50 by bolts, a plurality of fastening bolts B are required, and also, the gasket 90 is required to seal a gap between the suction space S1 and the discharge space S2, increasing an amount of components and an assembly time, resulting in an increase in fabrication costs.

Also, in the scroll compressor of FIGS. 1-2, as the inner circumferential surface of the discharge cover 80 is fastened to the fixed scroll 50 by bolts, a space for bolt fastening (the shaded portion in FIG. 2) is required outside of a range of the compression chamber(s) P in the fixed scroll 50, increasing a width of the fixed scroll 50 fabricated through casting and increasing an area exposed to the discharge space S2, which has a high temperature, and thus, a refrigerant filling the compression chamber(s) P may be overheated and degrade performance of the compressor. Further, as an overall weight of the compressor is increased, it is difficult for the compressor to be transported or installed.

Figure 3:
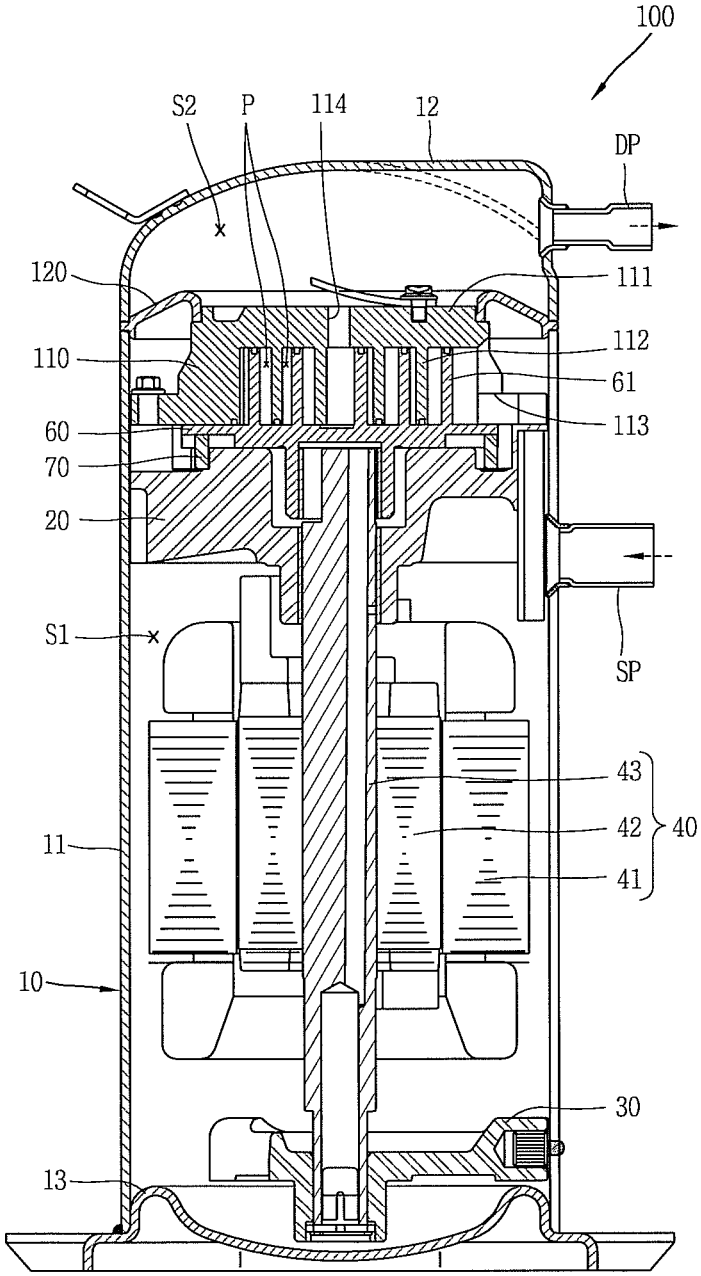
FIG. 3 is a vertical sectional view of a scroll compressor according to an embodiment.
Figure 4:
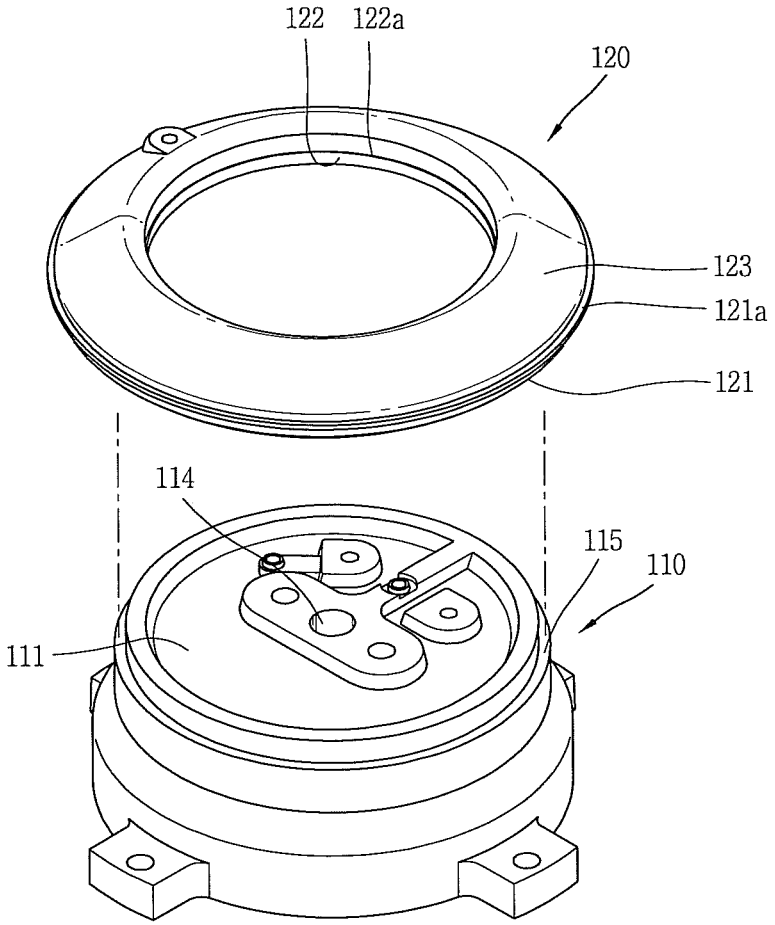
FIG. 4 is an exploded perspective view of a fixed scroll and a discharge cover of the scroll compressor of FIG. 3.
Figure 5:
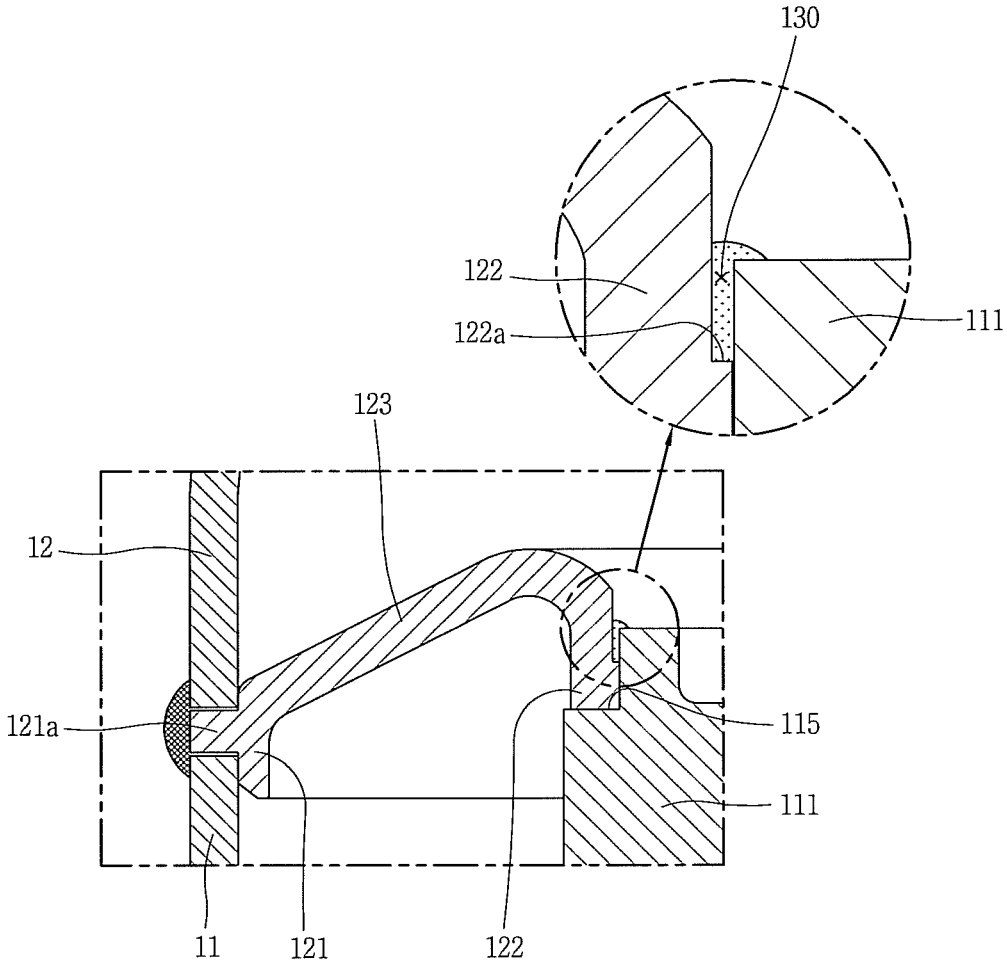
FIGS. 5 and 6 are enlarged views of an oil pocket portion formed between the fixed scroll and the discharge cover of the scroll compressor of FIG. 3.
Figure 6:
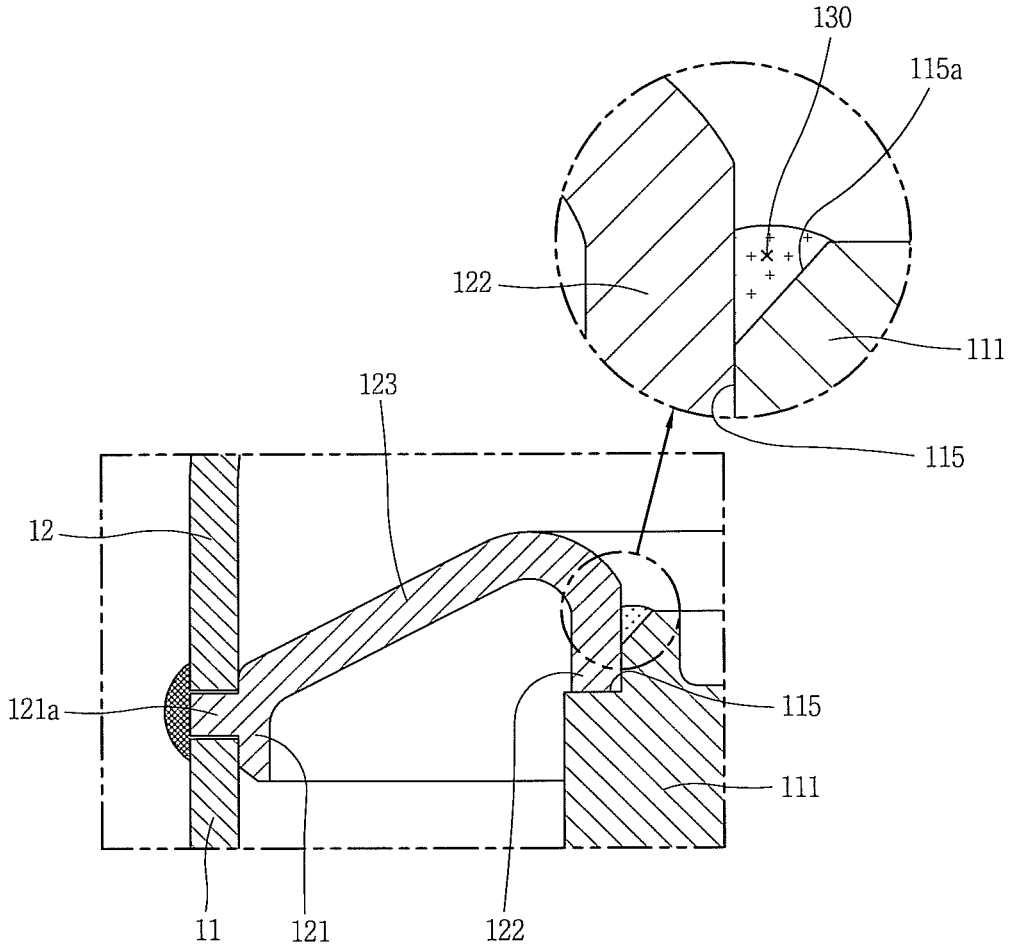
Figure 7:
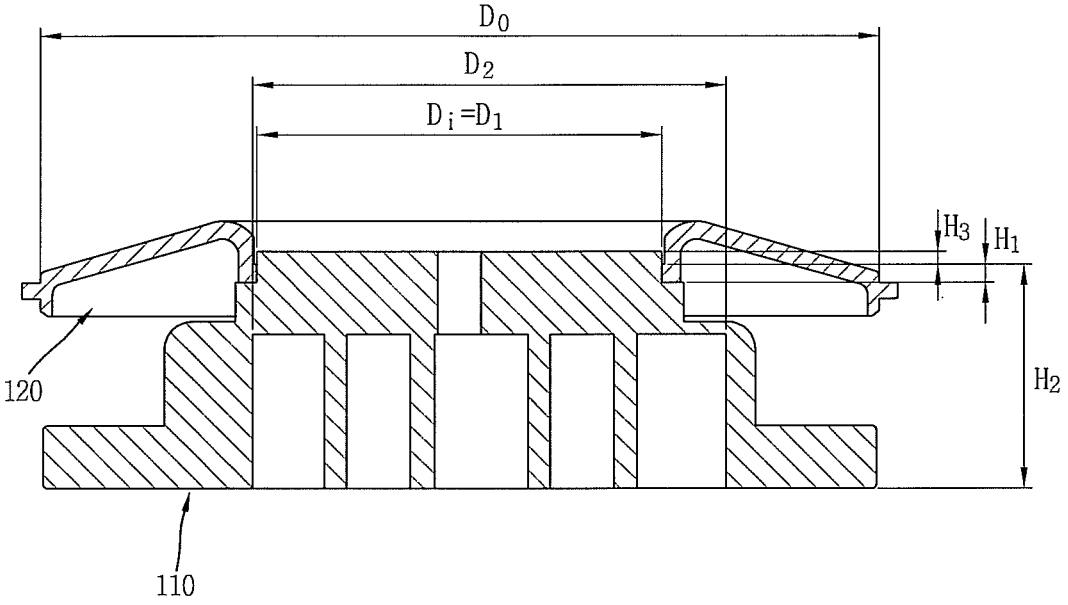
FIG. 7 is a schematic view illustrating dimensions of the fixed scroll and the discharge cover of the scroll compressor of FIG. 3.

FIG. 3 is a vertical sectional view of a scroll compressor according to an embodiment. FIG. 4 is an exploded perspective view of a fixed scroll and a discharge cover of the scroll compressor of FIG. 3. FIGS. 5 and 6 are enlarged views of an oil pocket portion formed between the fixed scroll and the discharge cover of the scroll compressor of FIG. 3. FIG. 7 is a schematic view illustrating dimensions of the fixed scroll and the discharge cover of the scroll compressor of FIG. 3.

As illustrated in FIG. 3, in the scroll compressor 100 according to this embodiment, an internal space of an airtight container 10 may be divided into a suction space S1, which functions as a low pressure part, and a discharge space S2, which functions as a high pressure part. A drive motor 40 that generates a rotational force (or rotatory power) may be installed in the suction space S1 of the airtight container 10. A main frame 20 may be fixedly installed between the suction space S1 and the discharge space S2 of the airtight container 10. A subframe 30 may be installed in or at a lower end of the suction space S1. The drive motor 40 may be installed between the main frame 20 and the subframe 30, and a fixed scroll 110 may be fixedly installed on an upper surface of the main frame 20.

An orbiting scroll 60 may be installed between the main frame 20 and the fixed scroll 110 such that it is gyrational. The orbiting scroll 60 may be eccentrically coupled to a crank shaft 43 of the drive motor 40 to form a pair of compression chambers P that continuously move, together with the fixed scroll 110. An Oldham ring 70 may be installed between the fixed scroll 110 and the orbiting scroll 60, in order to prevent the orbiting scroll 60 from being rotated.

The airtight container 10 may include a cylindrical shell 11, and an upper cap 12 and a lower cap 13 covering an upper opening end of the shell 11 and a lower opening end of the shell 11, respectively. A suction pipe SP may be coupled to communicate with the suction space S1 of the airtight container 10, and a discharge pipe DP may be coupled to communicate with the discharge space S2.

The airtight container 10 may include a hermetically sealed discharge space S2, and the suction space S1, which functions as a low pressure part, and the discharge space S2, which functions as the high pressure part, may be divided by a discharge plenum (not shown) fixedly coupled to the fixed scroll 110, or as shown in FIGS. 3 and 4, the internal space of the airtight container 10 may be divided into the suction space S1 and the discharge space S2 by a discharge cover 120 fixed to an upper surface of the fixed scroll 110 and tightly attached to an inner circumferential surface of the airtight container 10.

An entirety or a portion of an outer circumferential surface of the main frame 20 may be, for example, welded to an inner circumferential surface of the shell 11 of the airtight container 10. In a case in which the outer circumferential surface of the main frame 20 is tightly attached to the inner circumferential surface of the shell 11 of the airtight container 10, a communication hole (not shown) or a communication recess (not shown) that allows the suction space S1 and a suction opening 113 (to be described hereinbelow) to communicate with each other may be formed.

A disk plate 111 of the fixed scroll 110 may have an annular shape and may be fastened to an upper surface of the main frame 20 by, for example, a bolt, so as to be fixedly coupled thereto or may be, for example, press-fit and welded to the shell 11 of the airtight container 10.

The fixed scroll 110 may include a fixed wrap 112 that protrudes from a bottom of the disk plate 111 and forms the compression chamber(s) P together with an orbiting wrap 61 of the orbiting scroll 60. The fixed scroll 110 may include the suction opening 113 formed on an outer circumferential surface of the disk plate 111 that allows the suction space S1 of the airtight container 10 and the compression chamber(s) P to communicate with each other, and a discharge opening 114 formed in a central portion of the disk plate 111 of the fixed scroll 110 that allows the compression chamber(s) P and the discharge space S2 of the airtight container 10 to communicate with each other.

The fixed scroll 110 may include an annular fixed end 115 formed on an outer circumferential surface of an upper portion of the disk plate 111. An inner circumference sealing portion 122 of the discharge cover 120 (to be described hereinbelow) may be, for example, press-fit to the fixed end 115 so as to be fixedly coupled thereto. The fixed end 115 may be formed by removing a corner portion of an upper surface of the disk plate 111 of the fixed scroll 110 by a same depth (or height) in an axial direction.

The discharge cover 120 may be installed on an upper surface of the disk plate 111 of the fixed scroll 110, such that an internal space of the airtight container 10 may be divided into the suction space S1 and the discharge space S2. The discharge cover 120 may be formed, for example, by pressurizing a plate body having a predetermined thickness through a pressing method, to have a ring shape when viewed in a plane (i.e., when viewed from above). The outer circumference of the discharge cover 120 may be bent to form an outer circumference sealing portion 121, which may be tightly attached to the inner circumferential surface of the airtight container 10. A sealing protrusion 121*a* may be formed on an outer circumferential surface of the outer circumference sealing portion 121 to be, for example, welded and coupled between the shell 11 and the upper cap 12.

The inner circumference sealing portion 122 may be formed in the inner circumference of the discharge cover 120. The inner circumference sealing portion 122 may be inserted into the fixed end 115 of the fixed scroll 110 and tightly attached in a radial direction. The inner circumference sealing portion 122 may cover and surround the discharge opening 114 to separate the discharge opening 114 and the suction opening 113. The inner circumference sealing portion 122 may be insertedly coupled to the fixed end 115, such that an inner circumferential surface formed by bending an inner circumferential portion of the discharge cover 120 so as to be in contact with the fixed scroll 110 overlaps with an outer circumferential surface of the fixed scroll 110 in the axial direction. In other words, a lowermost point of the inner circumference sealing portion 122 of the discharge cover 120 may be lower than a rear surface of the fixed scroll 110 forming the discharge space S2, so that the inner circumference sealing portion 122 of the discharge cover 120 and an outer circumferential surface of the fixed scroll 110 may be coupled in an overlapping manner in the axial direction.

An oil pocket portion 130 may be formed by, for example, a step surface 122*a* on an inner circumferential surface of the inner circumference sealing portion 122. The oil pocket portion 130 may allow oil to fill between the inner circumference sealing portion 122 of the discharge cover 120 and the fixed end 115 of the fixed scroll 110 to prevent refrigerant from being leaked by the oil.

As illustrated in FIG. 5, the oil pocket portion 130 may be formed by the step surface 122*a* formed on the inner circumferential surface of the inner circumference sealing portion 122, or alternatively, as illustrated in FIG. 6, the oil pocket portion 130 may be formed by a chamfered surface 115*a* formed by chamfering a corner of the fixed end 115. Also, although not shown, the oil pocket portion 130 may also be formed by a space generated by forming the inner circumference sealing portion 122 such that it is downwardly sloped.

A horizontal directional cross-section area of the discharge cover 120 may be closely related to energy efficiency (EER) of the compressor. For example, when an outer diameter Do of the discharge cover 120 is fixed or maintained, as an inner diameter Di of the discharge cover 120 is decreased (namely, as the discharge cover is widened), an area of the fixed scroll 110 exposed to the discharge space S2 is decreased, and thus, a phenomenon that the fixed scroll 110 is heated by refrigerant having a high temperature and high pressure discharged to the discharge space S2 may be reduced. Then, a specific volume of the refrigerant sucked to the compression chamber(s) P may be increased to minimize suction loss, increasing energy efficiency of the compressor.

When the outer diameter of the discharge cover 120 is fixed or maintained, as the inner diameter Di thereof is increased (namely, as a width of the discharge cover is decreased), an area of the fixed scroll 110 exposed to the discharge space S2 is increased, and thus, the fixed scroll 110 may be heated by the refrigerant having a high temperature and high pressure discharged to the discharge space S2 to increase a specific volume of the refrigerant sucked to the compression chamber(s) P to increase suction loss, degrading energy efficiency of the compressor.

Figure 8:
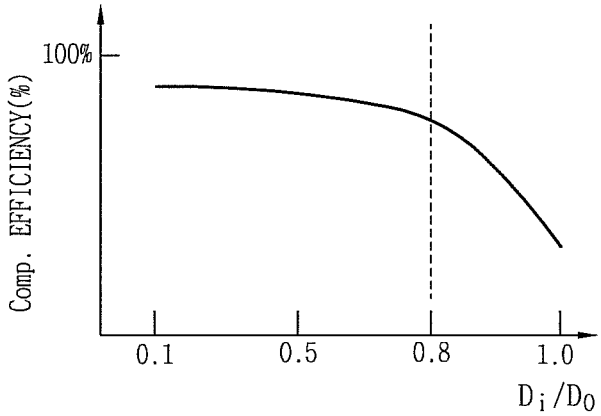
FIG. 8 is a graph showing a sealing effect according to a ratio of an inner diameter of a discharge cover to an outer diameter thereof in the scroll compressor of FIG. 3.

Thus, with embodiments discussed herein, the discharge cover 120 may be formed such that a ratio (Di/Do) of the inner diameter Di to the outer diameter Do is less than approximately 0.9, even less than approximately 0.8. In FIG. 8, it can be seen that when the ratio (Di/Do) of the inner diameter Di of the discharge cover 10 to the outer diameter Do thereof is more than approximately 0.8, energy efficiency (EER) of the compressor is rapidly degraded.

Figure 9:
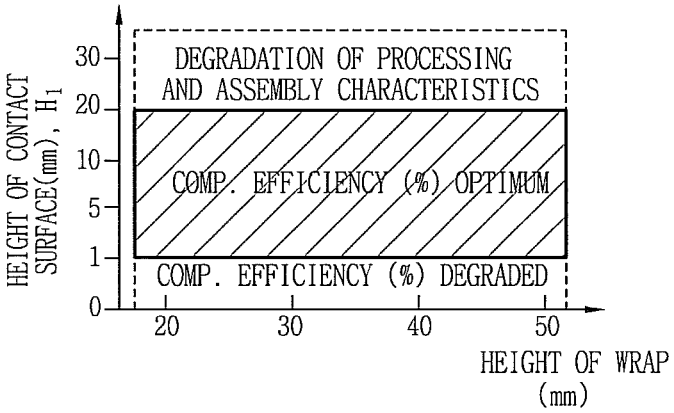
FIG. 9 is a graph showing a sealing effect according to a height of a wrap and a height of a contact surface of the discharge cover and the fixed scroll in the scroll compressor of FIG. 3.

A sealing height of the inner circumference sealing portion 122 disclosed herein may be appropriately set according to embodiments disclosed herein. For example, if the height H1 of the sealing surface of the inner circumference sealing portion 122 is too low, an entire sealing area may be too small to sufficiently seal the refrigerant to degrade compressor efficiency, and when the height H1 of the sealing surface is too high, the entire sealing area may be increased; however, an area of the fixed end 115 of the fixed scroll 110, to which the inner circumference sealing portion 122 of the discharge cover 120 is required to be tightly attached, and which is required to be precisely processed, is increased making it difficult to perform a processing operation. Thus, in order to easily process the fixed end 115, while increasing the sealing effect, the height of the contact surface (the height of the sealing surface) between the inner circumference sealing portion 122 of the discharge cover 120 and the fixed end 115 of the fixed scroll 110 may be in a range of about 5 to 25% of the height H2 of the fixed scroll 110, or a range of about 1 to 20 mm regardless of a wrap height, as shown in FIG. 9, whereby energy efficiency of the compressor may be optimized.

Thus, as illustrated in FIG. 7, at least a portion (the entirety in the drawing) of a diameter D1 of an outer circumferential surface of the fixed end 115 or a diameter (i.e., the inner diameter Di) of the inner circumferential surface of the discharge cover 120 may be formed to be positioned at an inner side rather than the diameter D2 connecting the inner circumferential surface of the outermost wrap of the fixed scroll 110, whereby an area of a rear surface of the fixed scroll 110 exposed to the discharge space S2 may be narrowed, and thus, the fixed scroll 110 may be prevented from being overheated by the refrigerant discharged to the discharge space S2, thus reducing suction loss of the compression chamber P.

Also, a height H3 of the oil pocket portion 130 in the axial direction may be formed to be smaller than or equal to the sealing height H1 of the inner circumference sealing portion (i.e., the height of the surface at which the inner circumferential surface of the discharge cover 120 and the outer circumferential surface of the fixed scroll 110 are in contact). If the height H3 of the oil pocket portion 130 in the axial direction is greater than the sealing height H1 of the inner circumference sealing portion, as described above, a volume of the oil pocket portion 130 may be reduced to reduce a sealing effect to degrade compressor performance or a width of the contact surface to be precisely processed may be excessively increased to cause difficulty in processing.

Meanwhile, the discharge cover 120 may have a sloped portion 123 formed between the outer circumference sealing portion 121 and the inner circumference sealing portion 122 and downwardly sloped toward the outer diameter, whereby pressure of the discharge space S2 acting on the discharge cover 120 may be distributed and oil may be guided to the outer circumference sealing portion 121.

Reference numeral 41 denotes a stator and reference numeral 42 denotes a rotor.

The scroll compressor according to embodiments may have the following operational effects. Namely, when power is applied to the drive motor 40 to generate rotational force, the orbiting scroll 60 eccentrically coupled to the crank shaft 43 of the drive motor 40 makes a gyrational movement to form a pair of (or two) compression chambers P continuously moving between the orbiting scroll 60 and the fixed scroll 50. The compression chambers P may be formed continuously in several stages, such that a volume thereof may be gradually reduced toward the discharge opening 114 (or a discharge chamber) from the suction opening 113 (or the suction chamber).

Then, the refrigerant sucked from the outside of the airtight container 10 may be introduced into the suction space S1, a low pressure portion, of the airtight container 10 through the suction pipe SP; the low pressure refrigerant in the suction space S1 may be introduced through the suction opening 113 of the fixed scroll 110 and move in a direction of a final compression chamber by the orbiting scroll 60 so as to be compressed; and then, the compressed refrigerant may be discharged to the discharge space S2 of the airtight container 10 through the discharge opening 114 of the fixed scroll 110 from the final compression chamber.

Then, as the discharge space S2 is separated from the suction space S1 by the discharge cover 120, the refrigerant discharged to the discharge space S2 may move to a refrigerating cycle through the discharge pipe DP, rather than flowing backward to the suction space S1. This sequential process may be repeatedly performed.

With the discharge cover 120 according to embodiments, the sealing protrusion 121*a* of the outer circumference sealing portion 121 may be interposed between the upper cap 12 and the shell 11 of the airtight container 10 and, for example, welded, and the inner circumference sealing portion 122 may be, for example, press-fit to the fixed end 115 of the fixed scroll 110. A predetermined amount of oil may be mixedly included in the refrigerant discharged to the discharge space S2, and the oil may be separated from the refrigerant and flow between the inner circumference sealing portion 122 and the fixed end 115 to fill the oil pocket portion 130. Thus, although a fine or small gap may be formed between the inner circumference sealing portion 122 and the fixed end 115, the gap may be blocked by the oil filling the oil pocket portion 130, effectively preventing the refrigerant in the discharge space S2 from being leaked to the suction space S1.

Thus, in comparison to a case in which the discharge cover is coupled to the fixed scroll by a plurality of fastening bolts, the amount of components, such as fastening bolts, and a gasket, may be reduced, and the assembly time for assembling the components may be reduced, reducing overall production costs.

Also, as fastening bolts are not used in the embodiments disclosed herein, a width corresponding to the space for bolts may be reduced in the fixed scroll, reducing an area of the fixed scroll exposed to the discharge space. Accordingly, a phenomenon in which the fixed scroll is heated by the refrigerant having a high temperature of the discharge space may be reduced, preventing the refrigerant sucked to the compression chamber(s) from being overheated to increase suction loss, whereby compressor efficiency may be enhanced. Also, as a size of the fixed scroll may be reduced to reduce a weight of the fixed scroll, a weight of the overall compressor may be reduced.

Embodiments disclosed herein provide a scroll compressor capable of reducing an amount of components for assembling a discharge cover and an assembly time.

Embodiments disclosed herein further provide a scroll compressor in which a discharge cover may be coupled to a fixed scroll without a bolt to reduce an area of the fixed scroll in contact with a discharge space having a high temperature, thus preventing a refrigerant in a compression chamber from being overheated, reducing a weight of the fixed scroll, and reducing an overall weight of the compressor.

Embodiments disclosed herein provide a scroll compressor that may include an airtight container; a fixed scroll fixed to an internal space of the airtight container and having a suction opening and a discharge opening; an orbiting scroll engaged with the fixed scroll to make a rotating movement and forming a compression chamber continuously moving together with the fixed scroll, while making the rotating movement; and a discharge cover coupled to the airtight container and the fixed scroll, that separates the internal space of the airtight container into a suction space that communicates the suction opening and a discharge space that communicates with the discharge opening. The discharge cover may have an annular shape and be coupled to the fixed scroll, such that an inner circumferential surface of the discharge cover overlaps with an outer circumferential surface of the fixed scroll in an axial direction.

Embodiments disclosed herein provide a scroll compressor that may include an airtight container; a fixed scroll fixed to an internal space of the airtight container and having a suction opening and a discharge opening; an orbiting scroll engaged with the fixed scroll to make a rotating movement and forming a compression chamber continuously moving together with the fixed scroll, while making the rotating movement; and a discharge cover coupled to the airtight container and the fixed scroll, that separates the internal space of the airtight container into a suction space that communicates with the suction opening and a discharge space that communicates with the discharge opening. The discharge cover may have an annular shape and be coupled to the fixed scroll, such that a height of a lowermost point of an inner circumferential surface of the discharge cover may be lower than a rear surface of the fixed scroll forming the discharge space, based on a lower end of the airtight container.

Embodiments disclosed herein provide a scroll compressor in which an internal space of an airtight container may be divided into a suction space and a discharge space by a discharge cover fixed to a fixed scroll, wherein an outer circumferential surface of the discharge cover may be welded to the airtight container, an inner circumferential surface of the discharge cover may be insertedly fixed to the fixed scroll, and at least a portion of the inner circumferential surface of the discharge cover may be positioned at an inner side rather than an inner circumferential surface of an outermost wrap forming a compression chamber.

An oil pocket portion may be formed in at least one of the inner circumferential surface of the discharge cover inserted into the outer circumferential surface of the fixed scroll or the outer circumferential surface of the fixed scroll corresponding to the inner circumferential surface of the discharge cover. The discharge cover may be formed such that a ratio (Di/Do) of an inner diameter Di thereof to an outer diameter Do thereof is less than approximately 0.8.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A scroll compressor, comprising:

an airtight container;

a fixed scroll that is fixed in an internal space of the airtight container and includes a suction opening and a discharge opening;

an orbiting scroll engaged with the fixed scroll, the orbiting scroll making a rotating movement and forming a compression chamber with the fixed scroll, the compression chamber continuously moving together with the orbiting scroll, while the orbiting scroll makes the rotating movement; and a discharge cover coupled to the airtight container and the fixed scroll, wherein the discharge covet separates the internal space of the airtight container into a suction space that communicates with the suction opening and a discharge space that communicates with the discharge opening, wherein the discharge cover is coupled to the fixed scroll, such that an inner circumferential surface of the discharge cover overlaps with an outer circumferential surface of the fixed scroll in an axial direction of the scroll compressor, wherein an oil pocket is formed between the inner circumferential surface of the discharge cover and the fixed scroll in contact therewith, which is configured to be filled with oil, and wherein the oil pocket includes a bottom surface which is formed lower than a surface of the fixed scroll forming a part of the discharge space.

2. The scroll compressor according to claim 1, wherein the oil pocket has an annular shape.

3. The scroll compressor of claim 1, wherein the oil pocket is formed by a step on the inner circumferential surface of the discharge cover or on the outer circumferential surface of the fixed scroll.

4. The scroll compressor of claim 1, wherein the oil pocket is formed by a chamfered surface on the outer circumferential surface of the fixed scroll.

5. The scroll compressor of claim 1, wherein the oil pocket is formed by a sloped surface on the inner circumferential surface of the discharge cover.

6. The scroll compressor of claim 1, wherein the discharge cover is formed such that a ratio (Di/Do) of an inner diameter Di thereof to an outer diameter Do thereof is less than approximately 0.8.

7. The scroll compressor of claim 1, wherein at least a portion of the inner circumferential surface of the discharge cover is positioned at an inner side of rather than at an inner circumferential surface of an outermost wrap forming the compression chamber.

8. The scroll compressor of claim 1, wherein a fixed end of the fixed scroll, into which the discharge cover is inserted, is formed to be stepped on the outer circumferential surface of the fixed scroll, wherein an inner circumferential sealing portion is formed by bending an inner circumferential portion of the discharge cover inserted into the fixed end, wherein a sealing portion is formed between an inner surface of the inner circumferential sealing portion and an outer surface of the fixed end, and wherein the oil pocket is formed at a location higher than the sealing portion.

9. The small compressor of claim 8, wherein the discharge covet further comprises a sloped portion that extends toward an inner surface of the airtight container from the inner circumferential portion of the discharge cover.

10. The scroll compressor of claim 8, wherein the airtight container is formed by covering a shell having both upper and lower ends open, with an upper cap and a lower cap, respectively, and wherein an outer circumferential sealing portion is formed by bending an outer circumferential portion of the discharge cover in a circumferential direction, and a sealing protrusion is formed on an outer circumferential surface of the outer circumferential sealing portion and interposed between the shell and the upper cap.

11. The scroll compressor of claim 10, wherein the sealing protrusion is configured to be interposed between the shell and the upper cap and welded.

12. The scroll compressor of claim 8, wherein a height of the oil pocket in an axial direction of the scroll compressor is smaller than a height of the inner circumferential sealing portion in the axial direction.

13. A scroll compressor, comprising:

an airtight container;

a fixed scroll that is fixed in an internal space of the airtight container and includes a suction opening and a discharge opening;

an orbiting scroll engaged with the fixed scroll, the orbiting scroll making a rotating movement and forming a compression chamber with the fixed scroll, the compression chamber continuously moving together with the orbiting scroll, while the orbiting scroll makes the rotating movement; and a discharge cover coupled to the airtight container and the fixed scroll, wherein the discharge cover separates the internal space of the airtight container into a suction space that communicates with the suction opening and a discharge space that communicates with the discharge opening, wherein the discharge cover is coupled to the fixed scroll, such that a height of a lowermost point of an inner circumferential surface of the discharge cover is lower than a surface of the fixed scroll that forms a part of the discharge space, with respect to a lower end of the airtight container, wherein a sealing portion is formed between the inner circumferential surface of the discharge cover, which is inserted into an outer circumferential surface of the fixed scroll, and the outer circumferential surface of the fixed scroll corresponding to the inner circumferential surface of the discharge cover, wherein an oil pocket is formed at at least one of the inner circumferential surface of the discharge cover or the outer circumferential surface of the fixed scroll corresponding to the inner circumferential surface of the discharge cover, and wherein the oil pocket is formed at a location higher than the sealing portion so as to prevent a refrigerant from being leaked by oil within the oil pocket.

14. The scroll compressor according to claim 13, wherein the oil pocket has an annular shape.

15. The scroll compressor of claim 13, wherein the oil pocket is formed by a step on the inner circumferential surface of the discharge cover or on the outer circumferential surface of the fixed scroll.

16. The scroll compressor of claim 13, wherein the oil pocket is formed by a chamfered surface on the outer circumferential surface of the fixed scroll.

17. The scroll compressor of claim 13, wherein the oil pocket is formed by a sloped surface on the inner circumferential surface of the discharge cover.

18. The scroll compressor of claim 13, wherein a fixed end of the fixed scroll, into which the discharge cover is inserted, is formed to be stepped on the outer circumferential surface of the fixed scroll, and wherein an inner circumferential sealing portion formed as an inner circumferential portion of the discharge cover is bent so as to be inserted into the fixed end.

19. The small compressor of claim 18, wherein the discharge cover further comprises a sloped portion that extends toward an inner surface of the airtight container from the inner circumferential portion of the discharge cover.

* * * * *